US008628353B2

(12) United States Patent
Yokoyama

(10) Patent No.: US 8,628,353 B2
(45) Date of Patent: Jan. 14, 2014

(54) COAXIAL CONNECTOR

(75) Inventor: Yohei Yokoyama, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 133 days.

(21) Appl. No.: 13/245,922

(22) Filed: Sep. 27, 2011

(65) Prior Publication Data

US 2012/0088403 A1 Apr. 12, 2012

(30) Foreign Application Priority Data

Oct. 6, 2010 (JP) ..... 2010-226440

(51) Int. Cl.
*H01R 9/05* (2006.01)

(52) U.S. Cl.
USPC ..... 439/582; 439/409

(58) Field of Classification Search
USPC ..... 439/582, 409, 394, 596
See application file for complete search history.

(56) References Cited

U.S. PATENT DOCUMENTS

| | | | | |
|---|---|---|---|---|
| 6,478,607 | B2 * | 11/2002 | Tabata | 439/456 |
| 6,676,445 | B2 * | 1/2004 | Hall et al. | 439/582 |
| 6,790,082 | B2 | 9/2004 | Obayashi | |
| 8,182,285 | B2 * | 5/2012 | Annequin et al. | 439/582 |
| 2011/0008999 | A1 * | 1/2011 | Annequin et al. | 439/582 |

FOREIGN PATENT DOCUMENTS

JP 2002-324636 11/2002

* cited by examiner

*Primary Examiner* — Phuong Dinh
(74) *Attorney, Agent, or Firm* — Collard & Roe, P.C.

(57) ABSTRACT

A coaxial connector includes a contact adapted to be connected to an inner conductor of a coaxial cable, an insulator holding the contact, and a conductive shell adapted to be connected to an outer conductor of the coaxial cable. The shell includes a shell pivotal portion having press-holding pieces adapted to fix the outer conductor of the coaxial cable under pressure, and a shell body portion pivotably supporting the shell pivotal portion and having an accommodation space adapted to accommodate therein at least the press-holding pieces.

5 Claims, 13 Drawing Sheets

COAXIAL CONNECTOR

This application is based upon and claims the benefit of priority from Japanese Patent Application No. 2010-226440, filed on Oct. 6, 2010, the disclosure of which is incorporated herein in its entirety by reference.

TECHNICAL FIELD

This invention relates to a coaxial connector adapted to be attached to an end portion of a coaxial cable.

BACKGROUND ART

In general, a coaxial cable for use in signal transmission, such as an antenna wire, comprises an inner conductor, an outer conductor disposed around the inner conductor, an insulator interposed between the inner conductor and the outer conductor, and an outer jacket covering the circumference of the outer conductor. To an end portion of the coaxial cable, a coaxial connector is attached for connection to a mating device or the like.

As such a coaxial connector, there is conventionally known, as shown in FIGS. 11 to 13, a coaxial connector 500 comprising a connection terminal 510 adapted to be connected to an inner conductor 610 of a coaxial cable 600, a metal shell 520 supporting the connection terminal 510 and adapted to be connected to an outer conductor 620 of the coaxial cable 600, and an insulating portion 530 interposed between the connection terminal 510 and the shell 520, wherein the inner conductor 610 and the connection terminal 510 are electrically connected together by bending the shell 520, the insulating portion 530, and the connection terminal 510 to thereby grasp the inner conductor 610 by the connection terminal 510 (see, e.g. JP-A-2002-324636).

In the case of the conventional coaxial connector 500, in order to improve the reliability of connection between the outer conductor 620 and the shell 520 and to improve the reliability of retention of the coaxial cable 600, an insulator 630, the outer conductor 620, and an outer jacket 640 of the coaxial cable 600 are held under pressure by means of respective tongues 522*a* of the shell 520 as shown in FIG. 13. Herein, since a cable press-holding portion B holding the coaxial cable 600 under pressure is a portion where the coaxial cable 600 is fixed by the tongues 522*a*, it cannot be bent as is different from those portions of the coaxial cable 600 other than the cable press-holding portion B.

The coaxial cable 600 is attached to the conventional coaxial connector 500 in the following manner. First, as shown in FIG. 11, the inner conductor 610 is disposed between a pair of contacts 511 of the connection terminal 510. Then, as shown in FIG. 12, the connection terminal 510 is bent by bending the shell 520 and the insulating portion 530 so that the connection terminal 510 grasps the inner conductor 610 in pressure contact therebetween. Then, as shown in FIG. 13, the coaxial cable 600 is held under pressure by bending the tongues 522*a* of the shell 520.

SUMMARY OF THE INVENTION

In the case of the conventional coaxial connector 500, as shown in FIG. 13, the cable press-holding portion B protrudes from a component accommodating portion A which is necessary for accommodating the connector components such as the connection terminal 510 and the insulating portion 530 in the shell 520, and therefore, the space on a device as a mounting object is restricted due to the space of the protruding cable press-holding portion B and to the space for handling the coaxial cable 600.

This invention is intended to solve the above-mentioned conventional problem, that is, it is an object of this invention to provide a coaxial connector that improves its mountability to a mounting object without impairing the ease of a coaxial cable press-holding operation.

According to an exemplary aspect of the present invention, there is provided a coaxial connector, the connector comprising: a contact adapted to be connected to an inner conductor of a coaxial cable; an insulator holding the contact; and a conductive shell adapted to be connected to an outer conductor of the coaxial cable, wherein the shell comprises: a shell pivotal portion having a press-holding piece adapted to fix the outer conductor of the coaxial cable under pressure; and a shell body portion pivotably supporting the shell pivotal portion and having an accommodation space adapted to accommodate therein at least the press-holding piece.

The term "pivotable" or "pivotably" referred to in this invention represents that the pivotal motion is enabled once or more, and is not limited to meaning that the pivotal motion is permanently enabled.

According to the coaxial connector of this invention, the shell pivotal portion is pivoted with respect to the shell body portion after the coaxial cable is held under pressure by the shell pivotal portion so that, in the state where the coaxial cable has been attached to the coaxial connector, it is possible to prevent a cable press-holding portion, where the coaxial cable is held under pressure by the press-holding piece, from protruding in a cable lead-out direction of the coaxial cable from a component accommodating portion which is necessary for accommodating the respective connector components, or it is possible to reduce the protruding amount of the cable press-holding portion from the component accommodating portion in the cable lead-out direction. As a consequence, it is possible to realize miniaturization of the coaxial connector in the cable lead-out direction and thus to improve its mountability to a mounting object.

Further, since the shell pivotal portion having the press-holding piece is provided so as to be pivotable with respect to the shell body portion, it is possible to arbitrarily select the posture of the shell pivotal portion with respect to the shell body portion which is suitable for the cable press-holding operation, and therefore, it is possible to improve the ease of the press-holding operation for the coaxial cable.

Further, by preventing protrusion of the cable press-holding portion from the component accommodating portion as described above, it is possible to prevent the cable press-holding portion from impeding the placement of other components with respect to the mounting object and thus to improve the mountability of the coaxial connector to the mounting object and, further, since the coaxial cable can be bent from the cable root of the coaxial connector (i.e. a portion where the coaxial cable is led out from the shell), the degree of freedom for handling the coaxial cable inside a device as the mounting object increases, thus contributing to miniaturization of the device as the mounting object.

MODE FOR CARRYING OUT THE INVENTION

Hereinbelow, a coaxial connector 100 according to an embodiment of this invention will be described with reference to the drawings.

(Embodiment)

The coaxial connector 100 according to this embodiment is adapted to be attached to an end portion of a coaxial cable 200 for use in signal transmission, such as an antenna wire, thereby electrically connecting the coaxial cable 200 to a mating connector (not illustrated) which is inserted into the coaxial connector 100.

The coaxial connector 100 is formed as an MCX connector which is a snap-on/pull-off mating miniature connector.

Figure 10:
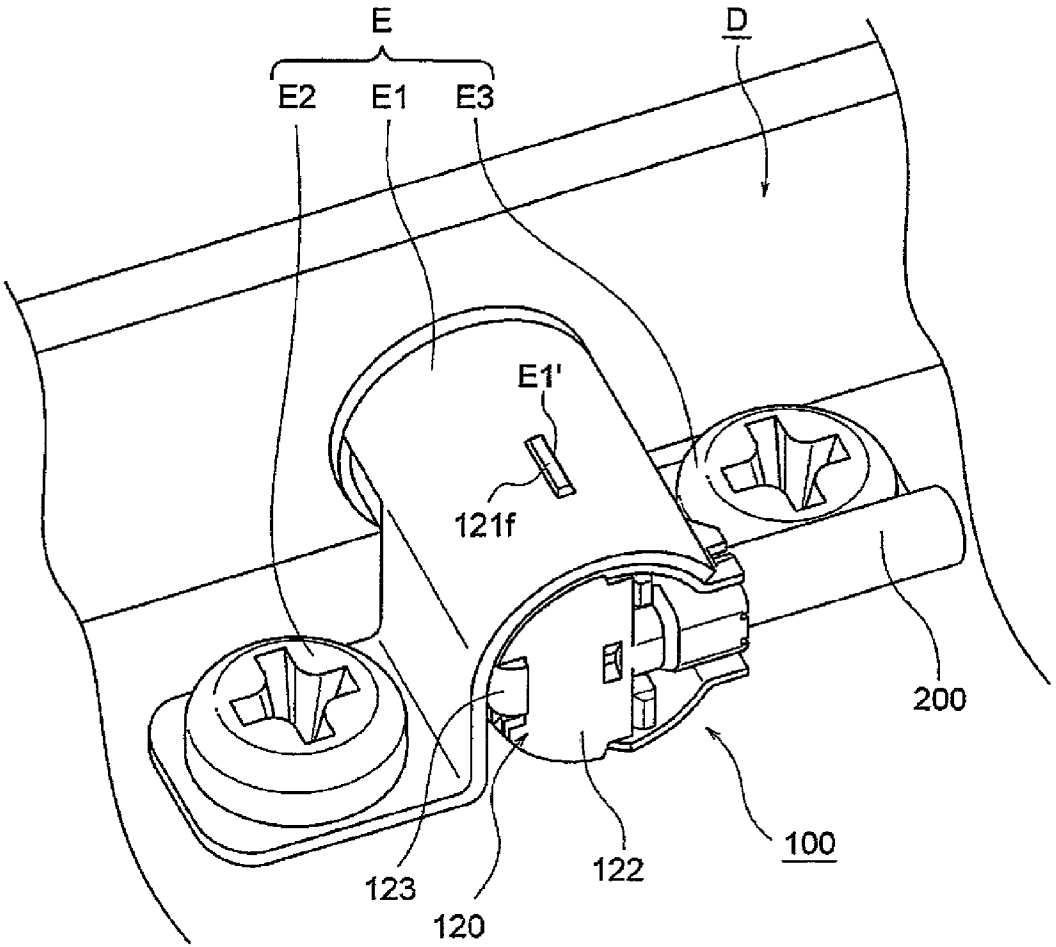
FIG. 10 is a using state diagram showing a state where the coaxial connector is mounted on a device.
Figure 11:
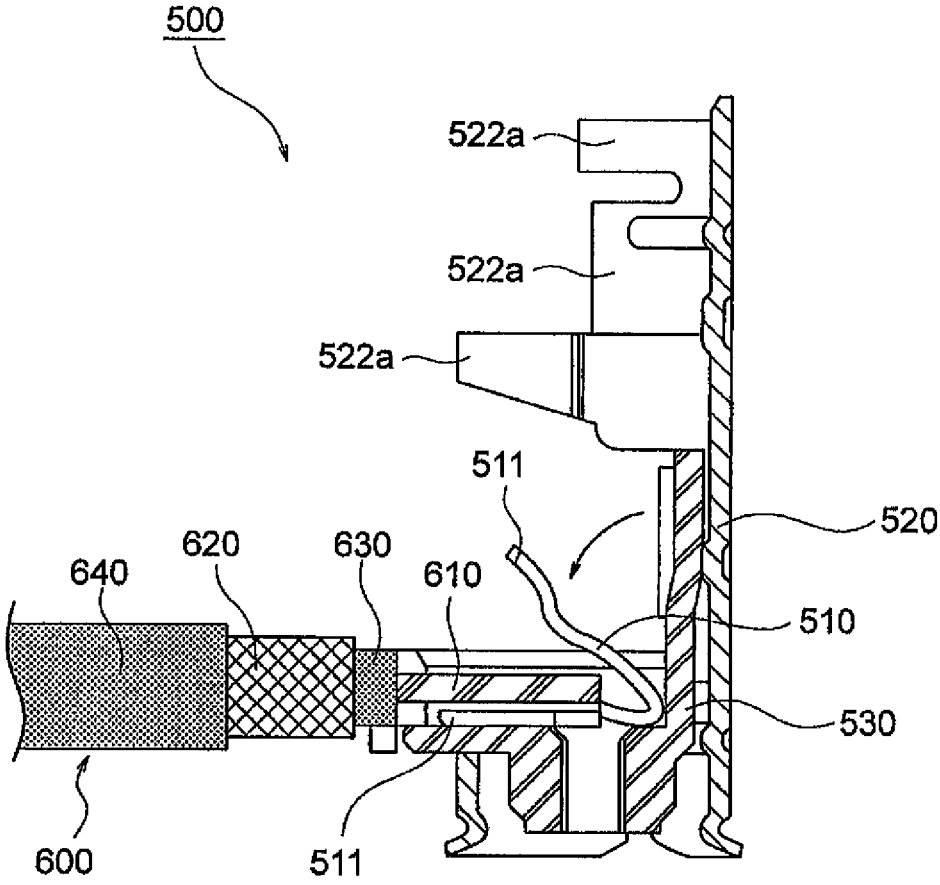
FIG. 11 is a cross-sectional view showing a conventional coaxial connector.
Figure 12:
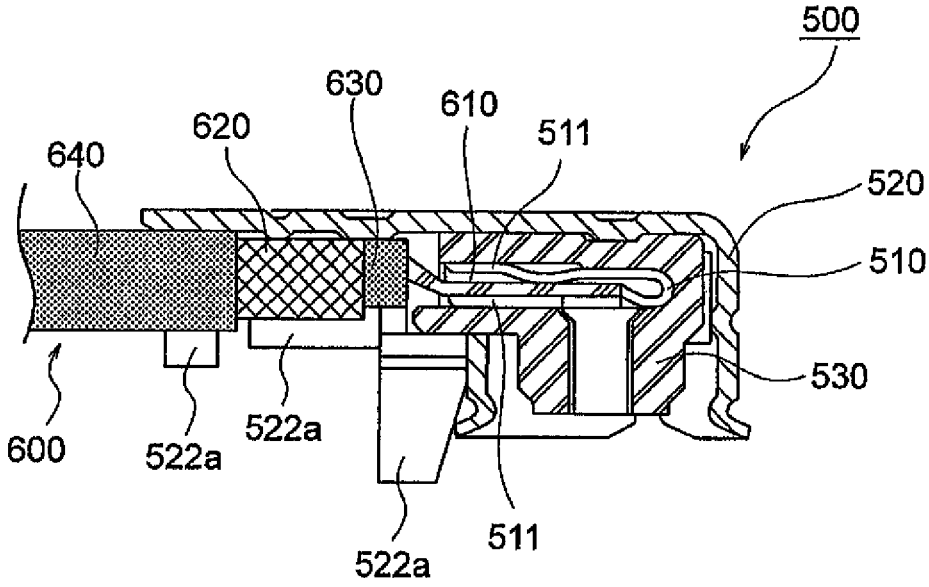
FIG. 12 is a cross-sectional view showing a state where a shell etc. of the coaxial connector are bent in the state of FIG. 11.
Figure 13:
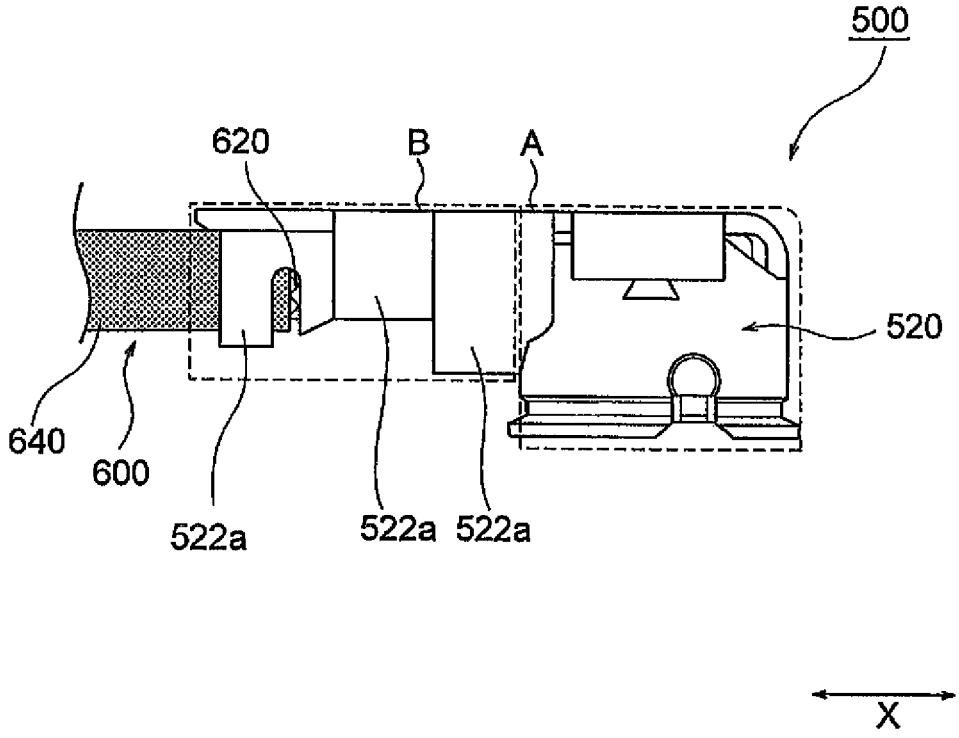
FIG. 13 is an explanatory diagram showing a state where a coaxial cable is held under pressure in the state of FIG. 12.

As shown in FIG. 10, the coaxial connector 100 is adapted to be mounted on a device D as a mounting object by means of a mounting member group E. The mounting member group E comprises a mounting member E1 and screws E2 and E3 for fixing the mounting member E1 to the device D.

Figure 1:
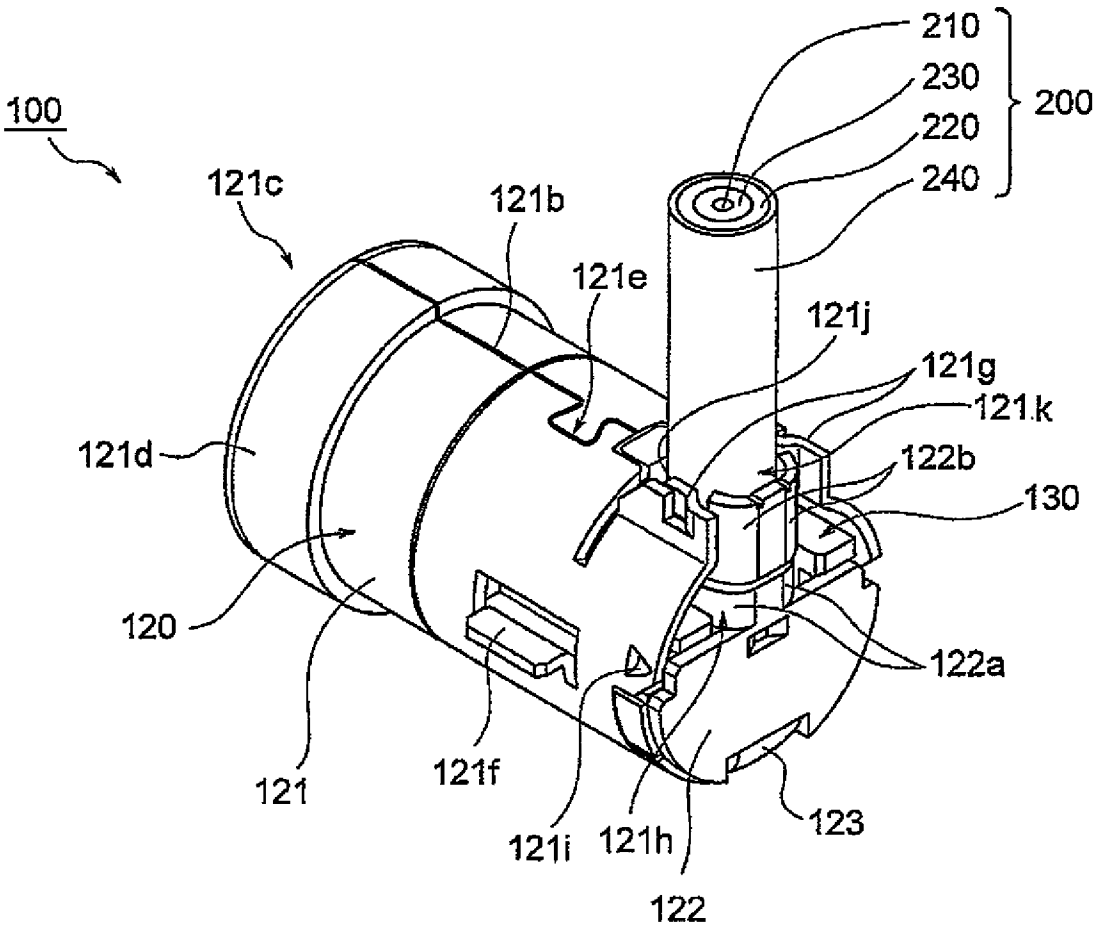
FIG. 1 is a perspective view showing a state where a coaxial cable is attached to a coaxial connector according to an embodiment of this invention.
Figure 3:
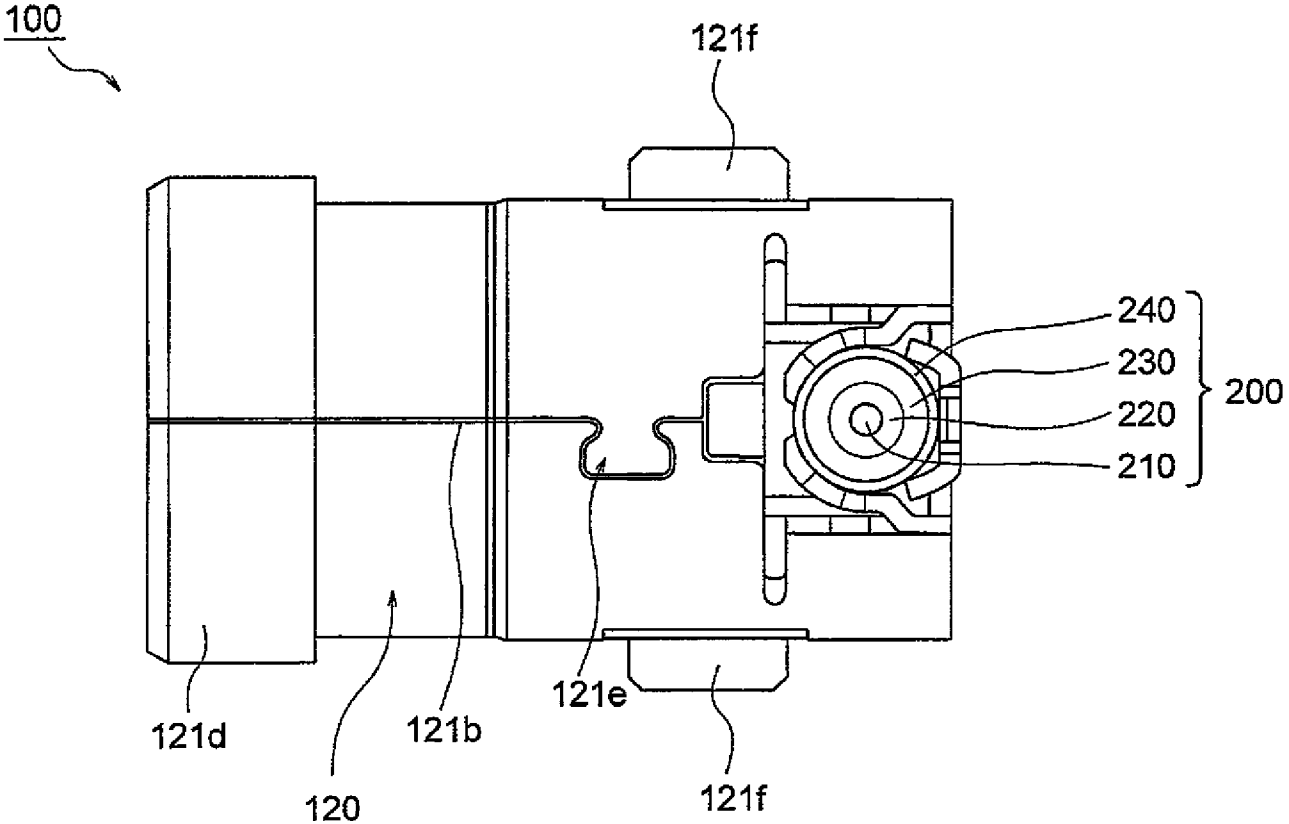
FIG. 3 is a plan view showing the state of FIG. 1 as seen in a direction different from that of FIG. 1.

As shown in FIGS. 1 and 3, the coaxial connector 100 comprises a conductive contact 110, a conductive shell 120, and an insulator 130.

Figure 4:
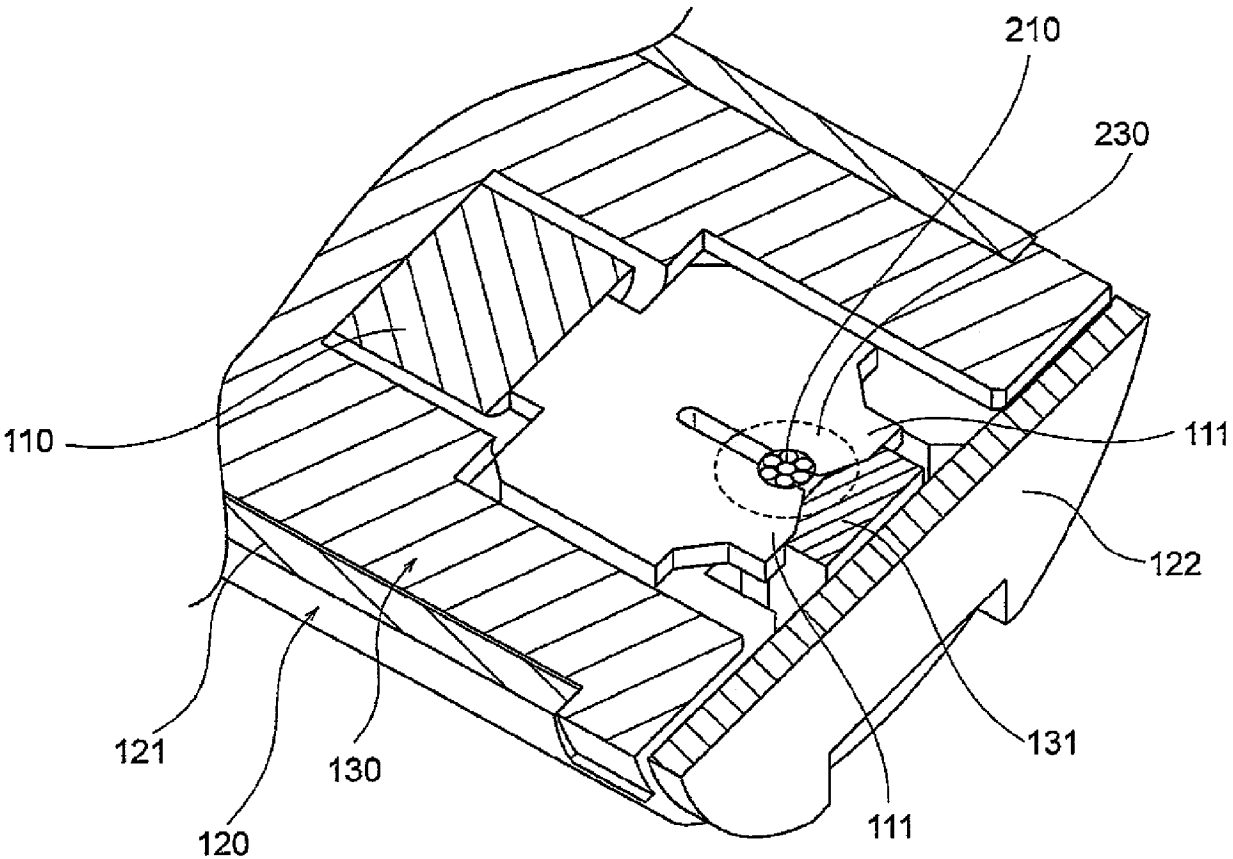
FIG. 4 is an explanatory diagram, partly sectioned, showing the state of FIG. 1.

The contact 110 is made of a copper alloy. As shown in FIG. 4, the contact 110 is adapted to be connected to an inner conductor 210 of the coaxial cable 200 and has a pair of pressure contact portions 111 adapted to receive therebetween the inner conductor 210 of the coaxial cable 200.

Figure 6:
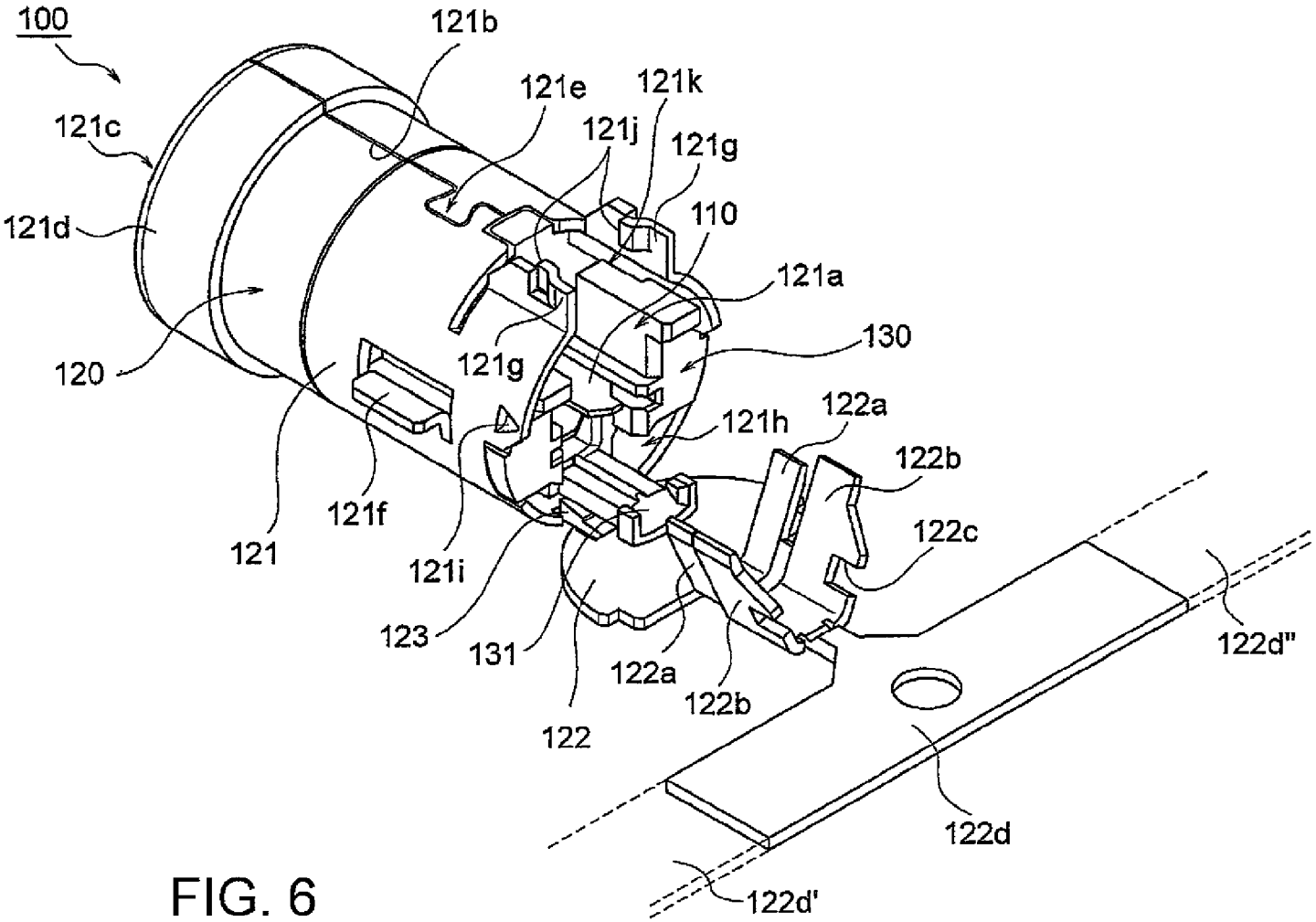
FIG. 6 is a perspective view explaining a method of attaching the coaxial cable to the coaxial connector.

The shell 120 is made of a copper alloy. As shown in FIG. 6 etc., the shell 120 accommodates therein the contact 110 and the insulator 130 and is adapted to be connected to an outer conductor 220 of the coaxial cable 200.

The shell 120 integrally comprises a shell body portion 121, a shell pivotal portion 122, and a shell coupling portion 123.

As shown in FIG. 1 etc., the shell body portion 121 is formed by bending and exhibits a hollow cylindrical shape as a whole.

In this embodiment, the shell body portion 121 is designed to have a length of about 7 mm in the shell longitudinal direction.

The shell body portion 121 has an accommodation space 121*a*, a slit portion 121*b*, an insertion opening 121*c*, a folded-back portion 121*d*, an engaging portion 121*e*, a pair of mounting projecting portions 121*f*, a pair of collar portions 121*g*, a shell pivotal portion side opening 121*h*, a pair of insulator locking portions 121*i*, a pair of shell pivotal portion engaging portions 121*j*, and a cable lead-out portion 121*k*.

As shown in FIG. 6 etc., the accommodation space 121*a* accommodates therein the contact 110 and the insulator 130 in the state where the shell pivotal portion 122 is not fixed to the shell body portion 121. On the other hand, as shown in FIG. 1 etc., in the state where the shell pivotal portion 122 is fixed to the shell body portion 121, the accommodation space 121*a* accommodates therein, in addition to the contact 110 and the insulator 130, press-holding pieces 122*a* and 122*b* of the shell pivotal portion 122, one end portion of the coaxial cable 200, and so on.

As shown in FIG. 1 etc., the slit portion 121*b* is formed in the shell body portion 121 along the shell longitudinal direction. The slit portion 121*b* serves to expand, i.e. increase the diameter of, the insertion opening 121*c* of the shell body portion 121 upon insertion of the mating connector into the coaxial connector 100, that is, serves to give elasticity or springiness to the shell body portion 121 to thereby facilitate the insertion of the mating connector.

Figure 2:
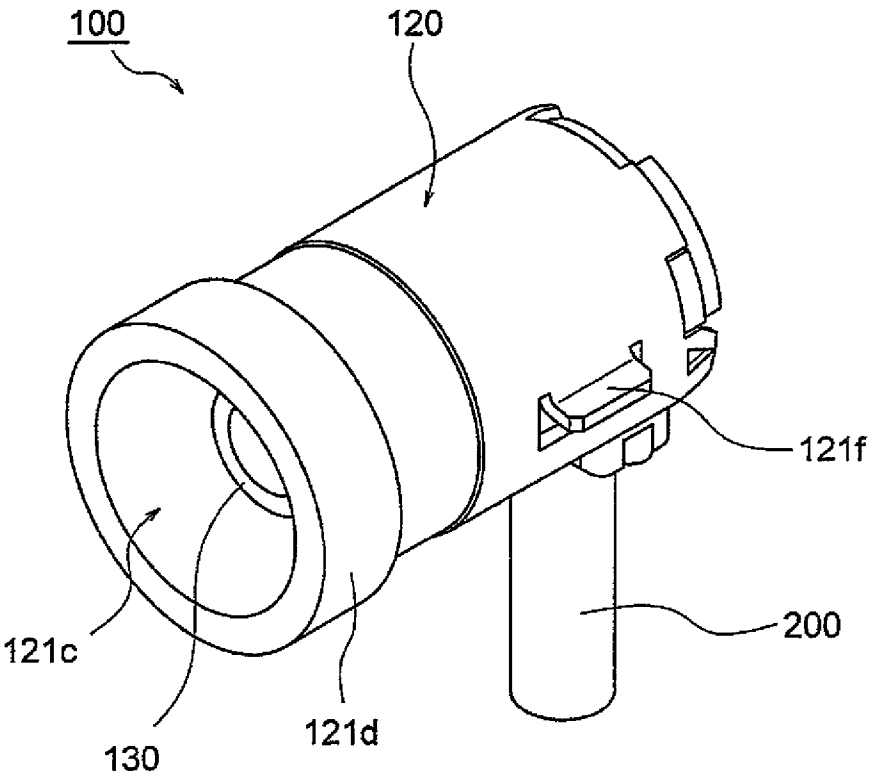
FIG. 2 is a perspective view showing the state of FIG. 1 as seen in a direction different from that of FIG. 1.

As shown in FIG. 2 etc., the insertion opening 121*c* is formed at one end, in the shell longitudinal direction, of the shell body portion 121 for allowing the mating connector to be inserted thereinto.

As shown in FIG. 1 etc., the folded-back portion 121*d* is formed by folding back the shell body portion 121 on the insertion opening 121*c* side and serves to smooth the insertion of the mating connector.

As shown in FIG. 1 etc., the engaging portion 121*e* serves to fix together both ends of the shell body portion 121, separated by the slit portion 121*b*, by concave-convex engagement. The engaging portion 121*e* is formed at a position away from, in the shell longitudinal direction, the insertion opening 121*c* into which the mating connector is inserted. With this configuration, as compared with the case where the engaging portion 121*e* is formed at a position near the insertion opening 121*c* in the shell longitudinal direction, the springiness of the shell body portion 121 upon insertion of the mating connector is further improved, i.e. the insertion opening 121*c* of the shell body portion 121 can be increased in diameter more smoothly, so that the insertion of the mating connector is further facilitated.

As shown in FIG. 1 etc., the mounting projecting portions 121*f* are formed to project outward from the circumference of the shell body portion 121 and are used when mounting the coaxial connector 100 on the device D as the mounting object. Specifically, as shown in FIG. 10, the mounting projecting portions 121*f* are respectively inserted into a mounting hole (not illustrated) formed in the device D and into a mounting hole E1' formed in the mounting member E1 of the mounting member group E.

The collar portions 121*g* are formed to project outward from the circumference of the shell body portion 121 and, as shown in FIG. 1 etc., are located around the press-holding pieces 122*b* and the coaxial cable 200 so as to be in contact with the press-holding pieces 122*b* in the state where the shell pivotal portion 122 is fixed to the shell body portion 121. With this configuration, it is possible to prevent the press-holding pieces 122*b* grasping the coaxial cable 200 from opening and thus to suppress reduction in contact reliability between the outer conductor 220 of the coaxial cable 200 and the shell 120. In this embodiment, as described above, it is configured such that the collar portions 121*g* are located around the press-holding pieces 122*b* so as to be in contact with the press-holding pieces 122*b*. Alternatively, it may be configured such that the collar portions 121*g* are located around the press-holding pieces 122*b* so as to press the press-holding pieces 122*b*. In this case, stronger cable retention can be obtained. However, neither configuration is essential. For example, the collar portions 121*g* may be spaced apart from the press-holding pieces 122*b*.

As shown in FIG. 1 etc., the shell pivotal portion side opening 121*h* is an opening formed at the other end, in the shell longitudinal direction, of the shell body portion 121.

As shown in FIG. 1 etc., the insulator locking portions 121*i* engage with the insulator 130 to fix the insulator 130 to the shell body portion 121, thereby preventing coming-off of the insulator 130.

As shown in FIG. 1 etc., the shell pivotal portion engaging portions 121*j* engage with engaging portions 122*c* of the shell pivotal portion 122 in the state where the shell 120 is bent (i.e. the shell pivotal portion 122 is pivoted), thereby fixing the shell pivotal portion 122 to the shell body portion 121.

As shown in FIG. 1 etc., the cable lead-out portion 121*k* is an opening formed in the vicinity of the collar portions 121*g* for leading out the coaxial cable 200 from the shell 120.

As shown in FIG. 1 etc., the shell pivotal portion 122 is provided so as to be pivotable with respect to the shell body portion 121, i.e. the shell pivotal portion 122 is pivotably supported by the shell body portion 121. In the state where the shell pivotal portion 122 is fixed to the shell body portion 121, the shell pivotal portion 122, along with the shell body portion 121, serves as a housing of the coaxial connector 100. An outer side surface of the shell pivotal portion 122, i.e. a side surface, which is in contact with a placement surface in a state shown in FIG. 7, of the shell pivotal portion 122, is formed flat.

As shown in FIG. 1 etc., the shell pivotal portion 122 has the pair of press-holding pieces 122*a*, the pair of press-holding pieces 122*b*, and the pair of engaging portions 122*c*.

Figure 8:
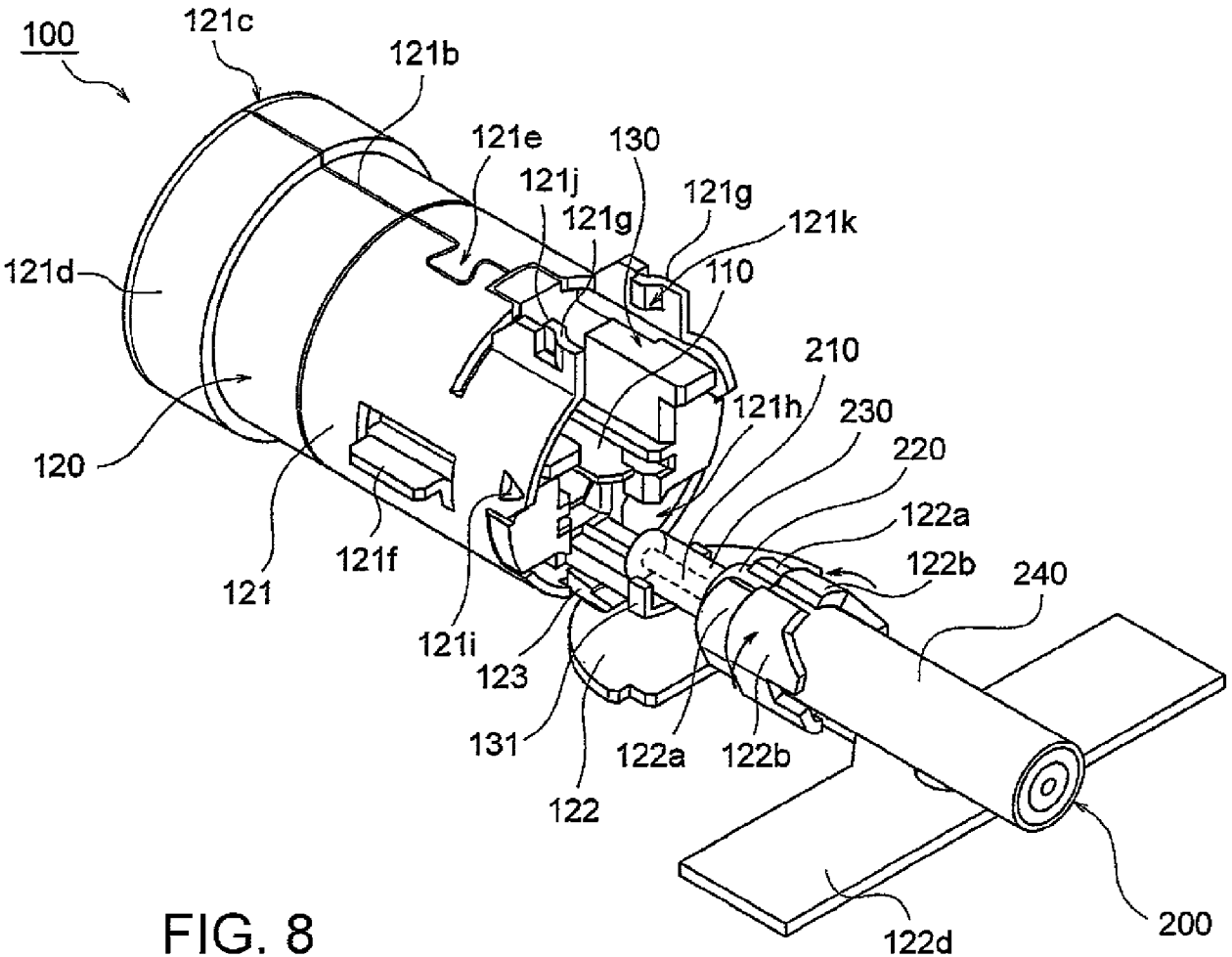
FIG. 8 is a perspective view showing a state where the coaxial cable is held under pressure in the state of FIG. 7.

As shown in FIG. 8, the press-holding pieces 122*a* grasp the outer conductor 220 of the coaxial cable 200 under pressure. By the contact between the press-holding pieces 122*a* and the outer conductor 220, the connection between the shell 120 and the outer conductor 220 is established. The press-holding pieces 122*a* are formed in such a size as to be accommodated in the accommodation space 121*a* of the shell body portion 121 in the state where the press-holding pieces 122*a* grasp the coaxial cable 200.

As shown in FIG. 8, the press-holding pieces 122*b* grasp an outer jacket 240 of the coaxial cable 200 under pressure. Although, in this embodiment, the outer jacket 240 is grasped using the press-holding pieces 122*b* as described above, the provision of the press-holding pieces 122*b* is not essential. When the press-holding pieces 122*b* are not provided, a means for fixing the outer jacket 240 may be separately provided.

The engaging portions 122*c* engage with the shell pivotal portion engaging portions 121*j* of the shell body portion 121 in the state where the shell 120 is bent (i.e. the shell pivotal portion 122 is pivoted), thereby fixing the shell pivotal portion 122 to the shell body portion 121.

As shown in FIG. 1, the shell coupling portion 123 is formed to be bendable and couples together the shell body portion 121 and the shell pivotal portion 122.

The term "bendable" referred to in this invention represents that the bending motion is enabled once or more, and is not limited to meaning that the bending motion is permanently enabled.

In this embodiment, the shell body portion 121 and the shell pivotal portion 122 are coupled together by the shell coupling portion 123 formed therebetween and the shell body portion 121, the shell pivotal portion 122, and the shell coupling portion 123 are integrally formed together. However, the shell body portion 121 and the shell pivotal portion 122 may be separately formed from each other and may be, for example, hinged together so as to be mutually pivotable.

The term "pivotable" or "pivotably" referred to in this invention represents that the pivotal motion is enabled once or more, and is not limited to meaning that the pivotal motion is permanently enabled.

Figure 7:
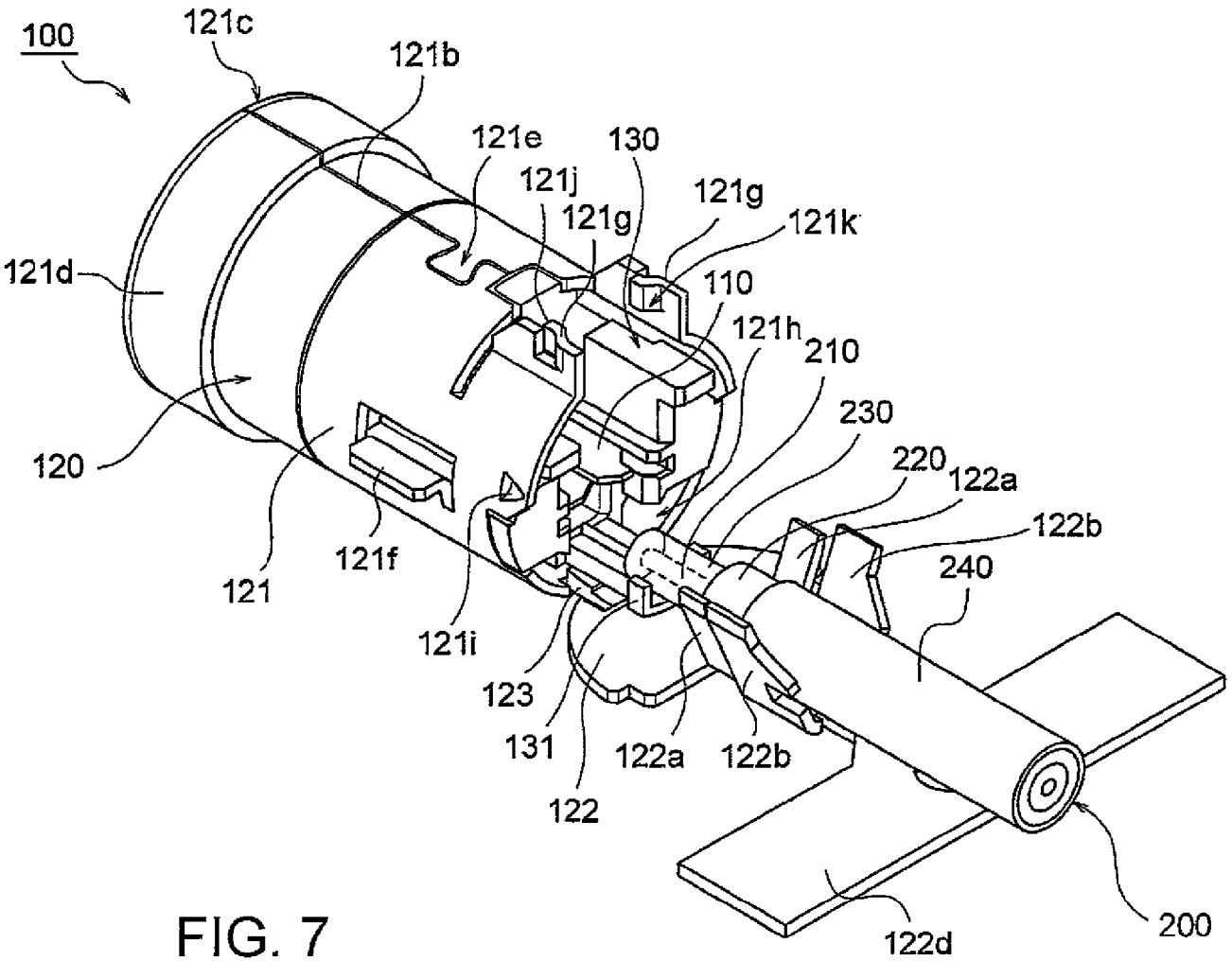
FIG. 7 is a perspective view showing a state where the coaxial cable is placed on press-holding pieces in the state of FIG. 6.

The insulator 130 is made of synthetic resin and, as shown in FIG. 7 etc., the insulator 130 holds the contact 110, is fixedly accommodated in the accommodation space 121*a* of the shell 120, and is interposed between the contact 110 and the shell 120.

As shown in FIG. 7 etc., the insulator 130 has a tray portion 131 disposed on the shell coupling portion 123.

As shown in FIG. 7 etc., in the state where the coaxial cable 200 is placed on the shell pivotal portion 122, the tray portion 131 receives an insulator 230 of the coaxial cable 200, thereby positioning the insulator 230 and the inner conductor 210 of the coaxial cable 200. Upon bending the shell 120 (i.e. pivoting the shell pivotal portion 122), the tray portion 131 is bent along with the shell 120.

As shown in FIG. 1 etc., the coaxial cable 200 comprises the inner conductor 210, the outer conductor 220 disposed around the inner conductor 210, the insulator 230 interposed between the inner conductor 210 and the outer conductor 220, and the outer jacket 240 covering the circumference of the outer conductor 220.

The inner conductor 210 of the coaxial cable 200 is adapted to be connected to the contact 110 of the coaxial connector 100 while the outer conductor 220 of the coaxial cable 200 is adapted to be connected to the shell 120 of the coaxial connector 100.

In this embodiment, the diameter of the coaxial cable 200 is set to about 1.32 mm.

The coaxial cable 200 can be smoothly bent at a portion other than a portion fixed by the press-holding pieces 122*a* and 122*b* (i.e. other than a later-described cable press-holding portion B), that is, at a portion located outside of the coaxial connector 100 in the state where the coaxial cable 200 has been attached to the coaxial connector 100 as shown in FIG. 1 etc.

Hereinbelow, a method of attaching the coaxial cable 200 to the coaxial connector 100 will be described with reference to FIGS. 6 to 9.

First, as shown in FIG. 6, the coaxial connector 100 is placed on the placement surface in the state where the shell pivotal portion side opening 121*h* of the shell body portion 121 is opened, i.e. in the state where the shell pivotal portion side opening 121*h* and the shell pivotal portion 122 form an angle of 90°.

In FIGS. 6 to 8, symbol 122*d* denotes a carrier integrally formed with the shell pivotal portion 122. This carrier 122*d* is coupled to carriers 122*d*' and 122*d*" of coaxial connectors (not illustrated) placed adjacent to the coaxial connector 100.

In the state shown in FIGS. 6 to 8, the shell pivotal portion 122 and the carrier 122*d* serve to prevent rotation of the coaxial connector 100 and thus to facilitate a later-described press-holding operation for the coaxial cable 200.

Then, as shown in FIG. 7, the coaxial cable 200 is placed with respect to the coaxial connector 100 in the state where the outer conductor 220 and the insulator 230 are partially exposed.

Specifically, the coaxial cable 200 is placed with respect to the coaxial connector 100 in the state where the insulator 230 and the inner conductor 210 are placed on the tray portion 131, the outer conductor 220 is placed between the pair of press-holding pieces 122*a*, and the outer jacket 240 is placed between the pair of press-holding pieces 122*b*.

Then, as shown in FIG. 8, the pair of press-holding pieces 122*a* are deformed to wrap around the circumference of the outer conductor 220, thereby grasping the outer conductor 220 under pressure by the pair of press-holding pieces 122*a* and, likewise, the pair of press-holding pieces 122*b* are deformed to wrap around the circumference of the outer jacket 240, thereby grasping the outer jacket 240 under pressure by the pair of press-holding pieces 122*b*.

Figure 9:
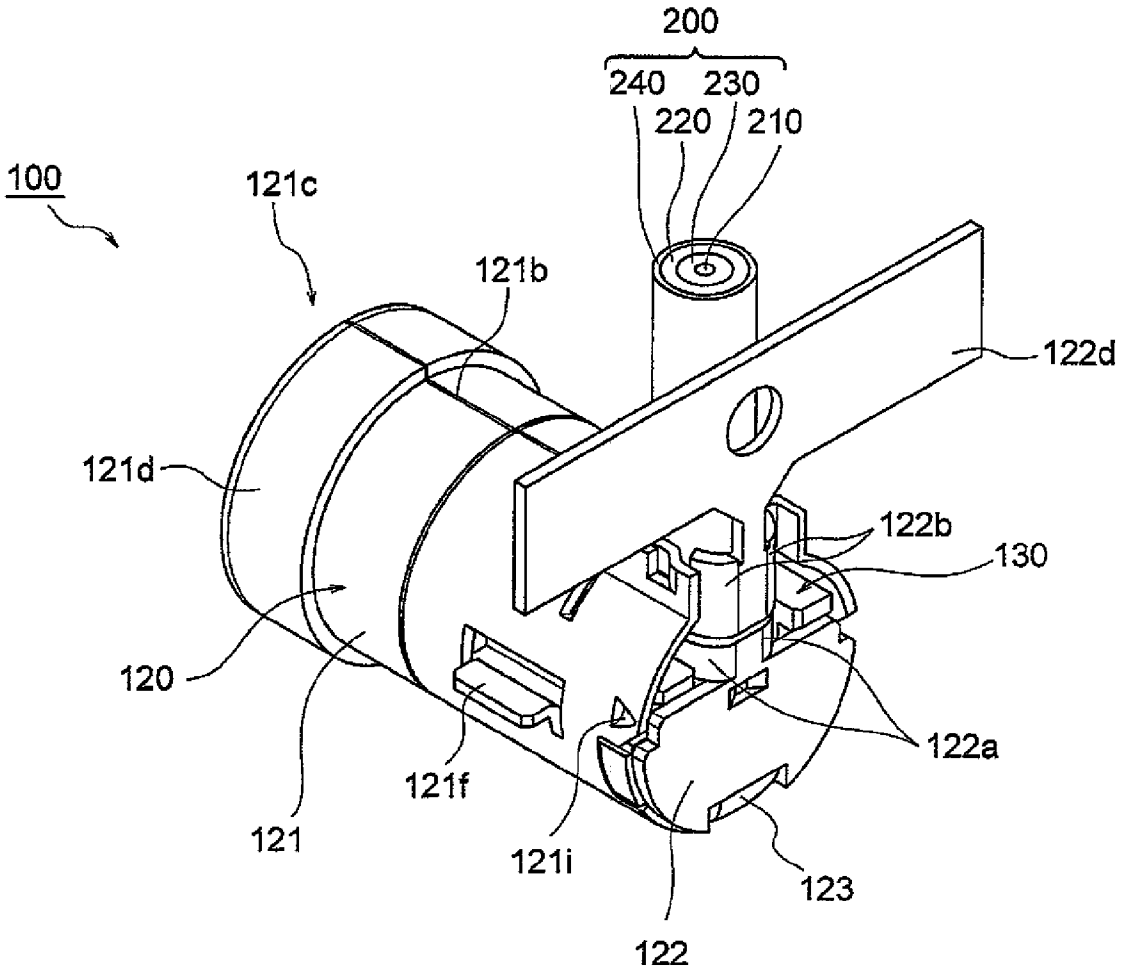
FIG. 9 is a perspective view showing a state where a shell pivotal portion is bent in the state of FIG. 8.

Then, as shown in FIG. 9, the shell 120 is bent, i.e. the shell pivotal portion 122 is pivoted by 90° toward the shell body portion 121 side by bending the shell coupling portion 123.

In this embodiment, the shell pivotal portion 122 is pivoted toward the shell body portion 121 side, but, to the contrary, the shell body portion 121 may be pivoted toward the shell pivotal portion 122 side.

In this event, the shell pivotal portion engaging portions 121*j* of the shell body portion 121 and the engaging portions 122*c* of the shell pivotal portion 122 engage with each other so that the shell pivotal portion 122 is fixed to the shell body portion 121.

When the shell pivotal portion 122 is pivoted, as shown in FIG. 4, the inner conductor 210 of the coaxial cable 200 automatically enters between the pair of pressure contact portions 111 of the contact 110 and, as a result, is brought into pressure contact with the contact 110. In this event, the insulator 230 of the coaxial cable 200 is torn off by the pressure contact portions 111 so that the inner conductor 210 is exposed.

In the case of the coaxial connector 100 of this embodiment, the connection between the contact 110 and the inner conductor 210 is achieved by fitting the inner conductor 210 between the pair of pressure contact portions 111 as described above. However, for example, the contact 110 and the inner conductor 210 may be connected to each other by soldering or the like.

Finally, the carrier 122*d* is snapped off in the state of FIG. 9, thereby reaching the state shown in FIG. 1.

Figure 5:
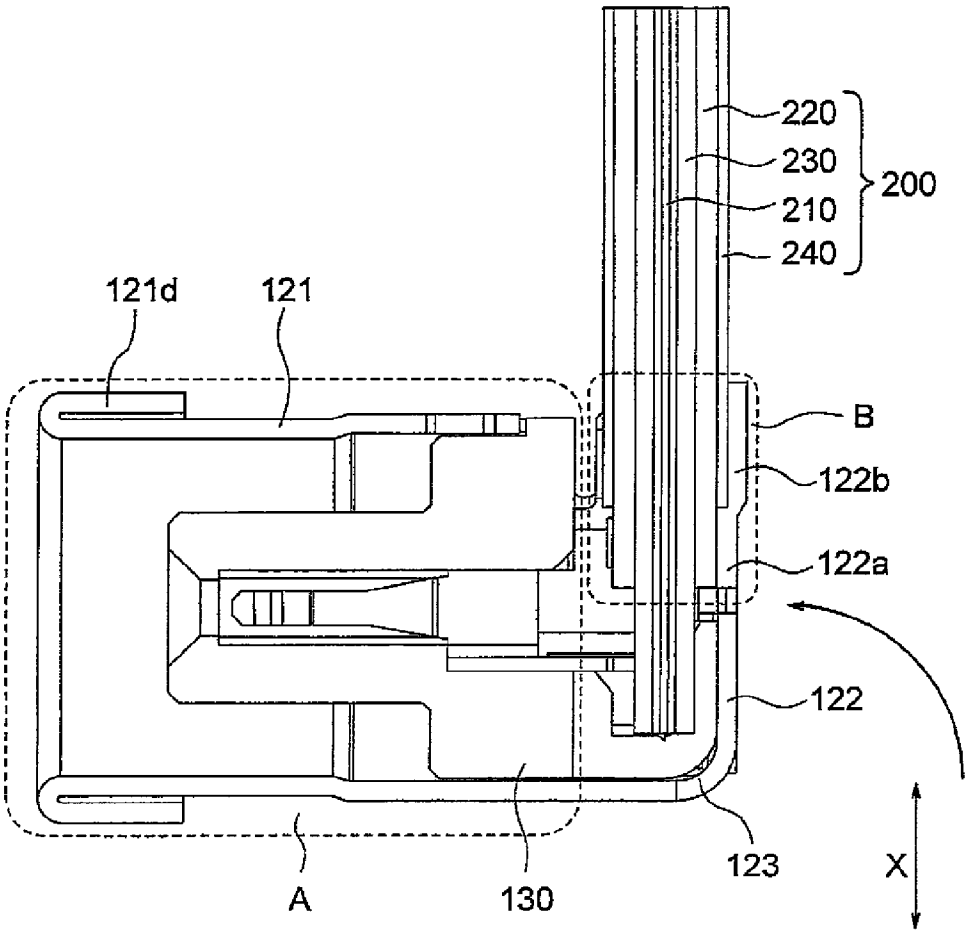
FIG. 5 is an explanatory diagram showing the state of FIG. 1 in a cross-sectional view.

According to the coaxial connector 100 of this embodiment thus configured, the shell pivotal portion 122 is pivoted with respect to the shell body portion 121 after the coaxial cable 200 is held under pressure by the shell pivotal portion 122 so that, as shown in FIG. 5, in the state where the coaxial cable 200 has been attached to the coaxial connector 100, it is possible to prevent the cable press-holding portion B, where the coaxial cable 200 is held under pressure by the press-holding pieces 122*a* and 122*b*, from protruding in a cable lead-out direction X of the coaxial cable 200 from a component accommodating portion A which is necessary for accommodating the respective connector components (i.e. it is possible to accommodate the cable press-holding portion B in the width of the component accommodating portion A in the cable lead-out direction X). As a consequence, it is possible to realize miniaturization of the coaxial connector 100 in the cable lead-out direction X and thus to improve its mountability to the mounting object.

Since the shell pivotal portion 122 is provided so as to be pivotable with respect to the shell body portion 121, it is possible to arbitrarily select the posture of the shell pivotal portion 122 with respect to the shell body portion 121 which is suitable for the cable press-holding operation, and therefore, it is possible to improve the ease of the press-holding operation for the coaxial cable 200.

Since the shell pivotal portion 122 is provided so as to be pivotable with respect to the shell body portion 121, the shell pivotal portion 122 serves to prevent rotation of the shell body portion 121 during the operation for the press-holding between the outer conductor 220 and the shell 120, and therefore, it is possible to smoothly carry out the cable press-holding operation.

By preventing protrusion of the cable press-holding portion B as described above, it is possible to prevent the cable press-holding portion B from impeding the placement of other components with respect to the device D as the mounting object and thus to improve the mountability of the coaxial connector 100 to the device D and, further, since the coaxial cable 200 can be bent from the cable root of the coaxial connector 100 (i.e. a portion where the coaxial cable 200 is led out from the cable lead-out portion 121*k* of the shell 120), the degree of freedom for handling the coaxial cable 200 inside the device D increases, thus contributing to miniaturization of the device D.

Since the shell body portion 121, the shell pivotal portion 122, and the shell coupling portion 123 are integrally formed together, it is possible to prevent increase in the number of components which would otherwise be caused by providing the shell pivotal portion 122.

Since the inner conductor 210 of the coaxial cable 200 is automatically brought into pressure contact with the contact 110 by means of the contact 110 following the pivotal motion of the shell pivotal portion 122, it is possible to reduce the work load for attaching the coaxial cable 200 to the coaxial connector 100.

According to the coaxial connector 100 of this embodiment, since the operation for the press-holding between the outer conductor 220 and the shell 120 is carried out before the inner conductor 210 and the contact 110 are brought into pressure contact with each other, as is different from a case where the former is carried out after the latter, it is possible to prevent the stress due to the cable press-holding operation from being applied to pressure contact portions between the inner conductor 210 and the contact 110 and thus to prevent degradation in contact reliability between the inner conductor 210 and the contact 110 and, further, since it is not necessary to consider the contact reliability of the pressure contact portions between the inner conductor 210 and the contact 110, the operation for the press-holding between the outer conductor 220 and the shell 120 is facilitated.

According to the coaxial connector 100 of this embodiment, since it is configured such that only the shell pivotal portion 122 is pivoted with respect to the shell body portion 121, it is possible to prevent the degree of freedom of design of the shell body portion 121 and the insulator 130 from being impaired.

Since the collar portions 121*g* are located around the press-holding pieces 122*b* in the state where the shell pivotal portion 122 is fixed to the shell body portion 121, it is possible to prevent the press-holding pieces 122*b* grasping the coaxial cable 200 from opening and thus to suppress reduction in contact reliability between the outer conductor 220 of the coaxial cable 200 and the shell 120.

What is claimed is:

1. A coaxial connector comprising:

a contact adapted to be connected to an inner conductor of a coaxial cable;

an insulator holding the contact; and a conductive shell adapted to be connected to an outer conductor of the coaxial cable, wherein the shell comprises:

a shell pivotal portion having a press-holding piece adapted to fix the outer conductor of the coaxial cable under pressure; and a shell body portion pivotably supporting the shell pivotal portion and having an accommodation space adapted to accommodate therein at least the press-holding piece.

2. The coaxial connector according to claim 1, wherein the shell pivotal portion has an engaging portion adapted to engage with the shell body portion to fix the shell pivotal portion to the shell body portion.

3. The coaxial connector according to claim 1, wherein the contact has a pair of pressure contact portions formed at a position to receive therebetween the inner conductor of the coaxial cable in pressure contact with each other when the shell pivotal portion is pivoted.

4. The coaxial connector according to claim 1, wherein the shell body portion has a collar portion located around the press-holding piece in a state where the press-holding piece is accommodated in the accommodation space.

5. The coaxial connector according to claim 1, wherein the shell further comprises a bendable shell coupling portion which is continuously formed between the shell body portion and the shell pivotal portion.

* * * * *